US010232484B2

(12) United States Patent
Sedlacek et al.

(10) Patent No.: US 10,232,484 B2
(45) Date of Patent: Mar. 19, 2019

(54) METHOD AND DEVICE FOR SIMULTANEOUS CENTRELESS CYLINDRICAL GRINDING OF MULTIPLE WORKPIECES

(71) Applicant: Tschudin GmbH Grenchen, Grenchen (CH)

(72) Inventors: Libor Sedlacek, Grenchen (CH); Urs Tschudin, Grenchen (CH)

(73) Assignee: TSCHUDIN GMBH GRENCHEN, Grenchen (CH)

( * ) Notice: Subject to any disclaimer, the term of this patent is extended or adjusted under 35 U.S.C. 154(b) by 57 days.

(21) Appl. No.: 15/645,359

(22) Filed: Jul. 10, 2017

(65) Prior Publication Data

US 2018/0015587 A1 Jan. 18, 2018

(30) Foreign Application Priority Data

Jul. 12, 2016 (EP) ..... 16179084

(51) Int. Cl.

| | |
|---|---|
| ***B24B 5/02*** | (2006.01) |
| ***B24B 5/04*** | (2006.01) |
| ***B24B 5/18*** | (2006.01) |
| ***B24B 5/30*** | (2006.01) |
| ***B24B 5/307*** | (2006.01) |
| ***B24B 5/22*** | (2006.01) |

(52) U.S. Cl.

CPC ..... *B24B 5/225* (2013.01); *B24B 5/02* (2013.01); *B24B 5/025* (2013.01); *B24B 5/04* (2013.01); *B24B 5/042* (2013.01); *B24B 5/18* (2013.01); *B24B 5/30* (2013.01); *B24B 5/307* (2013.01)

(58) Field of Classification Search

CPC .. B24B 5/02; B24B 5/025; B24B 5/04; B24B 5/042; B24B 5/18; B24B 5/225; B24B 5/30; B24B 5/307

USPC ..... 451/48, 49, 242, 244, 249

See application file for complete search history.

(56) References Cited

U.S. PATENT DOCUMENTS 2,322,620 A * 6/1943 Ekholm ..... B24B 5/18 451/242
4,062,150 A * 12/1977 Masuda ..... B24B 5/18 451/242

(Continued)

FOREIGN PATENT DOCUMENTS

EP 0 449 767 A1 10/1991
EP 2 394 783 A1 12/2011

*Primary Examiner* — Eileen Morgan
(74) *Attorney, Agent, or Firm* — Sughrue Mion, PLLC

(57) ABSTRACT

A method and device for simultaneous centerless cylindrical grinding of multiple workpieces (11, 12, 13, 14), at least sections of which are rotationally symmetrical, the workpieces are arranged on a support apparatus (200) one behind the other between at least one grinding wheel (110) and at least one regulating wheel (120), and wherein the axis of rotation of the regulating wheel is inclined with respect to a horizontal plane extending parallel to the workpiece axes of rotation and the grinding wheel axis of rotation by an inclination angle (α). During grinding the workpieces are arranged with a height offset relative to each other corresponding to at least a quarter of the inclination angle (α) of the axis of rotation of the regulating wheel with respect to the parallel plane to render the respective bearing angles (γ) of the workpieces on the inclined regulating wheel consistent.

14 Claims, 3 Drawing Sheets

(56) References Cited

U.S. PATENT DOCUMENTS

| | | | | | |
|---|---|---|---|---|---|
| 4,083,151 | A | * | 4/1978 | Jessup | B24B 5/01 451/242 |
| 4,570,386 | A | * | 2/1986 | Unno | B24B 53/04 125/11.03 |
| 4,570,387 | A | * | 2/1986 | Unno | B24B 49/183 125/11.01 |
| 4,712,332 | A | * | 12/1987 | Smith | B24B 5/22 451/244 |
| 4,783,932 | A | * | 11/1988 | Sager | B24B 5/30 451/242 |
| 5,643,051 | A | * | 7/1997 | Zhou | B24B 5/22 451/11 |
| 2011/0306273 | A1 | | 12/2011 | Tschudin et al. | |

* cited by examiner

METHOD AND DEVICE FOR SIMULTANEOUS CENTRELESS CYLINDRICAL GRINDING OF MULTIPLE WORKPIECES

The invention relates to a method for simultaneous centreless cylindrical grinding of multiple workpieces at least sections of which are rotationally symmetrical. The invention further relates to a grinding device and use thereof for carrying out such a method.

Methods and devices for centreless cylindrical grinding of substantially rotationally symmetrical workpieces are generally known from the prior art, from DIN 8589, Part 11 for example. Unlike other circular grinding methods, in centreless cylindrical grinding the workpiece is not clamped in place in force-locking manner, but instead it is positioned in the "grinding gap" between a grinding wheel and a regulating wheel, and is supported by a usually rail-like or fence-like support apparatus. The grinding and regulating wheels rotate in the same direction but at different speeds. During the grinding process, the workpiece is driven by the slowly rotating regulating wheel and machined by the grinding wheel, which rotates faster than regulating wheel. The support apparatus and the regulating wheel brace the workpiece over at least a part its length and absorb the forces that are generated during machining.

Simultaneous machining and bearing give rise to phenomena called "polygon effects" on the cylindrical surface of the workpiece during centreless grinding. In order to counteract these effects and achieve optimal roundness of the workpieces, it is also necessary to position the workpieces higher or lower than the axes of rotation of the grinding and regulating wheels by corresponding height adjustment of the support apparatus. If the centrepoint of the workpiece is above the line that connects the centrepoints of the grinding and regulating wheels, this is called "grinding above centre". If the workpiece centrepoint is lower than this connecting line, this is called "grinding below centre". The exact adjustment above or below the centrepoint is absolutely critical for achieving optimal roundness of the workpieces.

Regarding centreless cylindrical grinding, a fundamental distinction is made between throughfeed grinding and plunge grinding. During throughfeed grinding, a continuous succession of workpieces with uniform grinding diameter passes axially through the grinding gap. In order to generate the axial thrust, the regulating wheel is typically inclined by 1.5° to 3.5°, with the result that the workpieces are drawn through the grinding gap. In the case of plunge grinding, the axes of rotation of the grinding wheel and the regulating wheel are aligned almost parallel with each other, but at a slight angle of about 0.5° relative to each other to induce a forward thrust, pressing the workpiece against a limit stop which is precisely defined in the axial direction relative to the grinding device and thus retaining it firmly in its axial position. In practice, the axis of rotation of the regulating wheel is often inclined by a corresponding angle relative to a plane extending parallel to the axes of rotation of the grinding wheel and the workpieces, the plane particularly being horizontal.

With the plunge grinding technique, besides simple production it is also possible to grind multiple workpieces at the same time in one grinding using a single grinding machine (multiple production). For this, the workpieces are arranged in a line one behind the other on the support apparatus and ground simultaneously with a grinding and regulating wheel of appropriate width. Alternatively, multiple grinding and regulating wheels may be used, in particular a pair consisting of one grinding wheel and one regulating wheel for each workpiece. In addition, a limit stop is typically provided for each workpiece. However, it often happens that the roundnesses and precision quality in workpieces that have been ground simultaneously after undergoing plunge grinding with one grinding cycle in a multiple production process are variable in most cases.

Accordingly, the object of the present invention is to obtain more consistent quality in terms of uniform quality and optimum roundness of workpieces that are ground simultaneously in one cycle of a plunge grinding process.

This object is solved with the method according to claim 1 and with the device according to claim 4 and the use thereof according to claim 15. Further advantageous variations of the invention are the object of the respective dependent claims.

According to the invention, a method is suggested for carrying out simultaneous centreless cylindrical grinding or centreless plunge grinding of multiple workpieces at least sections of which are rotationally symmetrical, for the performance of which the device according to the invention as described hereinafter may be used. In this method, the workpieces are arranged for grinding one behind the other in the direction of their axes of rotation on a support apparatus between at least one grinding wheel and at least one regulating wheel, and the axis of rotation of the regulating wheel is tilted at an angle of inclination with respect to a plane that extends parallel to the axes of rotation of the grinding wheel and the workpieces, the plane being in particular horizontal. The method according to the invention is differs from others of its kind in that when they are ground the workpieces are arranged in the grinding gap one behind the other, i.e. in the direction of their axes of rotation, with a height offset relative to each other that corresponds to at least a quarter, particularly at least half, and preferably at least three quarters of the angle by which the axis of rotation of the regulating wheel is inclined with respect to the parallel plane, in order to adapt the respective bearing angles of the workpieces against the inclined regulating wheel. This means that the height offset, in particular a notional connecting line through the geometrical centres of gravity of the height-offset workpieces, extends along a line that is inclined with respect to the parallel plane by at least a quarter, particularly by at least half, and preferably at least three quarters of the angle of inclination of the axis of rotation of the regulating wheel.

In the context of the invention, it was found that in the simultaneous grinding method as performed previously each of the workpieces is at a different height or overheight/depth position relative to the regulating wheel due to the inclination of the axis of rotation of the regulating wheel, with the result that the bearing angle of the workpieces against the regulating wheel, which is crucial for roundness, is different for each workpiece. The crux of the invention consists in rendering the respective bearing angles of the workpieces against the regulating wheel as consistent as possible, preferably identical.

For the purposes of the present invention, the bearing angle is defined as the angle between the tangent with the regulating wheel in the contact area of the workpieces and the plumb or vertical. This angle corresponds to the angle between the line connecting the axis of rotation of the regulating wheel to the axis of rotation of the workpiece and the horizontal.

The workpieces that are to be ground to a round form may be for example shafts, bars, bolts or the like, that is to say that at least portions of such workpieces are rotationally symmetrical. In particular, the method for simultaneous grinding of similarly shaped workpieces suggested according to the invention differs from other methods of the kind.

According to a first advantageous variant of the invention, it is provided that during grinding the workpieces are arranged on the support apparatus one behind the other with a height offset with respect to each other in such manner that a notional connecting line passing through the geometric centres of gravity of the workpieces is substantially parallel to the inclined axis of rotation of the regulating wheel. This applies particularly when the workpieces to be ground simultaneously in one grinding cycle are similar or identical. Alternatively, it may be provided that during grinding the workpieces are arranged on the support apparatus one behind the other and with a height offset relative to each other corresponding to the inclination angle of the regulating wheel axis of rotation in such manner that each workpiece presents substantially the same bearing angle to the inclined regulating wheel.

For the purposes of the invention, the term "substantially the same" bearing angle means that the respective bearing angles of the workpieces against the regulating wheel do not vary by more than 1%, particularly not more than 0.5% from each other. The height-offset arrangement of the workpieces in the grinding gap is preferably selected such that the bearing angles of all workpieces against the regulating wheel are similar or identical. The variation range of the bearing angles of not more than 1%, particularly not more than 0.5%, may serve to position the workpieces so that their bearing on the grinding wheel is as consistent as possible.

The method according to the invention lends itself well to "inline plunge grinding", in which the axis of rotation of the grinding wheel and the axes of rotation of the workpieces are parallel to each other. On the other hand, the suggested method is also suitable for "offset plunge grinding", in which the grinding wheel and the workpieces are not disposed parallel to each other but in which the axis of rotation of the grinding wheel extends at an angle to the axes of rotation of the workpieces with respect to the particularly horizontal plane which extends parallel to the axis of rotation of the grinding wheel and the axes of rotation of the workpieces.

In order to achieve precise concentricity and the correct geometrical shape of the grinding wheel and the regulating wheel, in practice the wheels are often dressed before the first machining process or when they have become unusable due to wear. Possible dressing tools for this purpose include for example single-grain diamonds, multi-grain diamonds, or diamond-studded dressing wheels. In order to be able to fully exploit the advantages gained by the method suggested according to the invention, according to a further advantageous variant of the invention it is suggested that to achieve optimal roundness of the workpieces the inclined working wheel be dressed before grinding by means of a height-adjustable dressing device at the places where the workpieces bear on the regulating wheel depending on their height offset during grinding, i.e. to enable the regulating wheel to be dressed at various heights along the axis of rotation of the regulating wheel. Since in plunge grinding the grinding wheel determines a mirror-symmetrical shape of the workpieces to be ground round, it may be provided that the grinding wheel also be dressed before grinding, preferably using the height-adjustable dressing device, also at the places where the workpieces bear on the grinding wheel depending on their height offset during grinding. In particular, it may be provided to dress the grinding wheel, preferably using the height-adjustable dressing device, to different diameters along the axis of rotation of the grinding wheel so that the grinding wheels remain in contact with each of the workpieces disposed with height offset one behind the other.

The invention further relates to a device for simultaneous centreless cylindrical grinding of multiple workpieces, at least regions of which are rotationally symmetrical, particularly for carrying out the method according to the invention described previously, wherein the device includes at least one grinding wheel and at least one regulating wheel, between which the workpieces to be ground may be disposed on a support apparatus one behind the other in the direction of their axes of rotation. The grinding device is constructed in such manner that the axis of rotation of the regulating wheel is tiltable by an angle of inclination with respect to a particularly horizontal plane that extends parallel to the axes of rotation of the grinding wheel and of the workpieces. According to the invention, the support apparatus of the grinding device is constructed in such manner that during grinding the workpieces are disposed with a height offset with respect to each other which corresponds to at least a quarter, particularly at least half, preferably at least three quarters of the angle of inclination of the regulating wheel axis of rotation relative to the parallel plane, so that the respective bearing angles of the workpieces against the inclined regulating wheel can be made consistent during grinding. Accordingly, the support apparatus of the grinding device is constructed such that the height-offset arrangement, particularly a notional connecting line through the geometrical centres of gravity of the height-adjustable workpieces, extends along a line which is inclined with respect to the parallel plane by at least a quarter, particularly at least half, preferably at least three quarters of the angle of inclination of the regulating wheel axis of rotation.

As explained previously with regard to the method according to the invention, according to an advantageous variant of the grinding device according to the invention it may be provided that the support apparatus is constructed in such manner that during grinding a notional connecting line passing through the geometrical centres of gravity of the workpieces that are intended to bear or already bearing on the support apparatus extends parallel to the inclined axis of rotation of the regulating wheel. In corresponding manner, it may also be provided that the support apparatus is constructed in such manner that during grinding the workpieces are disposed with a height offset relative to each other corresponding to the angle of inclination of the regulating wheel axis of rotation in such manner that each workpiece bears on the inclined regulating wheel with substantially the same bearing angle. For the purposes of the device description, the "bearing angle" and the feature "substantially the same bearing angle" are to be interpreted in the same way as in the description of the method according to the invention.

According to a particularly preferred inventive variant, the support apparatus is equipped with a corresponding multiplicity of support points arranged one behind the other in the direction of the workpiece axes of rotation to support the multiple workpieces, which support points are also arranged with height offset relative to each other corresponding to the inclination angle of the regulating wheel axis of rotation. In particular, it may be provided that the support apparatus for supporting the multiple workpieces is designed in the form of steps, or the support points are arranged in the form of steps one behind the other. Each of the support points may have a support surface similar to an approach ramp, for example, which rises towards the grinding wheel at an angle to the axis of rotation of the workpiece to be supported thereon, particularly perpendicularly thereto, and at an angle to the grinding gap, particularly perpendicularly thereto. The inclined support surface forms the "workpiece support angle" with the particularly horizontal plane which extends parallel to the axes of rotation of the workpieces and the grinding wheel axis of rotation, which is typically between 10° and 50°, particularly between 30° and 45°.

According to an advantageous variant of the invention it may be provided that the height-offset supports for the workpieces are constructed for example as parts separate from each other. It is also conceivable for these separate supports to be arranged in or on a common support base.

In order to be able to adjust the superelevation of the workpieces relative to the axes of rotation of the regulating wheel and the grinding wheel, it may further be provided that the support apparatus as a whole is constructed such that its height is adjustable via or with the aid of the common support base(s). For this purpose, the support apparatus may be equipped with an adjustable, preferably actuator-operated height adjustment device. It may also be provided that the support apparatus is designed to be replaceable as a unit, so that the grinding device may be fitted with various support apparatuses depending on the geometry of the workpieces to be ground, in the manner of a swappable assembly.

In order to enable fine adjustment of the height offset of the individual workpieces and/or adaptation of the support apparatus for simultaneous grinding of workpieces with different geometries, according to a particularly preferred embodiment of the invention it may be provided that at least one, preferably each of the multiple supports is designed to be height-adjustable separately. Specifically, it may be provided that at least one, preferably each of the multiple supports is designed as a separately height-adjustable support element. For this purpose, preferably actuator-operated height adjustment devices may be provided for each. Additionally, the separately height-adjustable support elements may also be disposed on or in a common support base, which in turn may particularly serve to adjust the height of the support apparatus as a whole, i.e. all of the separately height-adjustable support elements at once.

For certain applications, it may also be necessary to tilt the support surface of the support apparatus relative to the axis of rotation of the grinding wheel, particularly out of the horizontal. For this purpose, according to a further advantageous variant of the invention it may be provided that at least one, preferably each of the multiples supports is tiltable separately with respect to the axis of rotation of the grinding wheel, particularly out of the horizontal. For this purpose, the support apparatus may be equipped particularly with an adjustable, preferably actuator-operated tilt adjustment device. In particular, at least one and preferably each of the multiple supports may be designed as support elements that are separately tiltable relative to the axis of rotation of the grinding wheel, particularly out of the horizontal. For this purpose, a tilt adjustment device may be provided correspondingly for each support element. However, it is also conceivable that the supports and support elements be arranged on or in a common support base, which is tiltable relative to the axis of rotation of the grinding wheel, particularly out of the horizontal, possibly with the aid of a tilt adjustment device.

A support apparatus that is technically easier to create than the separately height-adjustable support apparatus described earlier, but is just as precise and stable, may be provided for example if at least two, particularly all of the supports are disposed or constructed with a fixed height offset relative to each other that corresponds to the angle of inclination of the regulating wheel axis of rotation. In particular, the at least two, particularly all of the supports may be constructed as a single part, integrally or monolithically.

The controlled inclination of the regulating wheel axis of rotation moves the workpieces forwards in the direction of their axis of rotation during grinding, so that the workpieces are pressed in precisely controlled manner against a limit stop and retained in the grinding device so as to be axially immovable. Correspondingly, according to a further variant of the invention it is conceivable that for the method according to the invention at least one limit stop is provided for each workpiece or the grinding device according to the invention has at least one limit stop for each workpiece, on which the workpiece bears in the direction of its axis of rotation during grinding. Alternatively, the limit stop may also be formed by corresponding shaping of the regulating wheel, for example, possibly by a radial ridge, on which the workpiece bears in positive locking manner and is thus secured against undergoing axial displacement.

According to a further advantageous variant of the invention, it is provided that the grinding wheel comprises multiple partial grinding wheels arranged one behind the other on its axis of rotation, and the regulating wheel comprises multiple partial regulating wheels arranged one behind the other on its axis of rotation. Preferably one partial grinding wheel and one partial regulating wheel are provided for each workpiece to be ground.

As explained previously in the description of the method according to the invention, for the purpose of individual, controlled dressing of the regulating wheel taking into account the height-offset arrangement of the workpieces to be ground, according to a further advantageous variant of the invention the grinding device may include at least one approachable, particularly height-adjustable dressing device for dressing the at least one regulating wheel, preferably also for dressing the at least one grinding wheel, to dress the regulating wheel in targeted manner before grinding at the places where the workpieces bear on the regulating wheel during grinding depending on their height-offset arrangement.

The suggested grinding device may be designed so that the axis of rotation of the workpieces is aligned parallel to the axis of rotation of the grinding wheel to enable inline plunge grinding. On the other hand, however, the grinding device may also be designed such that the axis of rotation of the grinding wheel is aligned at an angle with respect to the axes of rotation of the workpieces, particularly within the horizontal, to enable offset plunge grinding.

The present invention further relates to the use of a device according to the invention as described previously to carry out the method according to the invention described in the introduction.

Further details of the invention and particularly an exemplary embodiment of the invention will be explained in the following with reference to the accompanying drawing. In the drawing.

Figure 1:
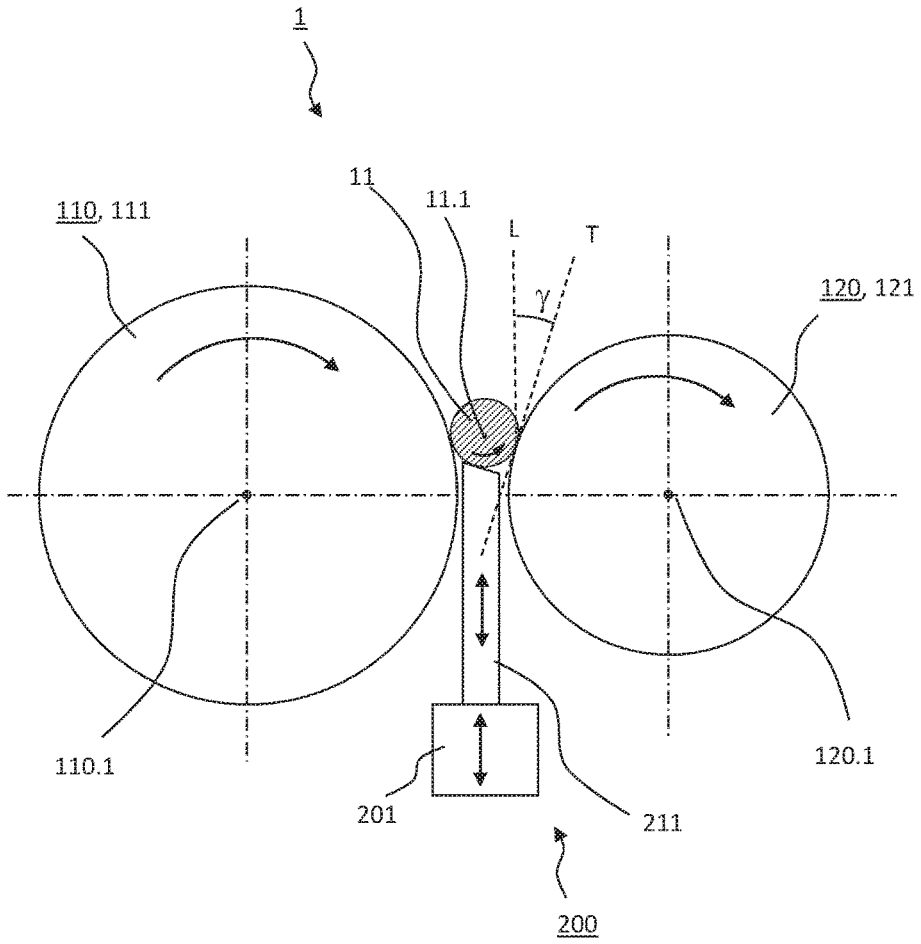
FIG. 1 shows a front view of one possible embodiment of a grinding device according to the invention for simultaneous centreless cylindrical grinding of multiple workpieces.
Figure 2:
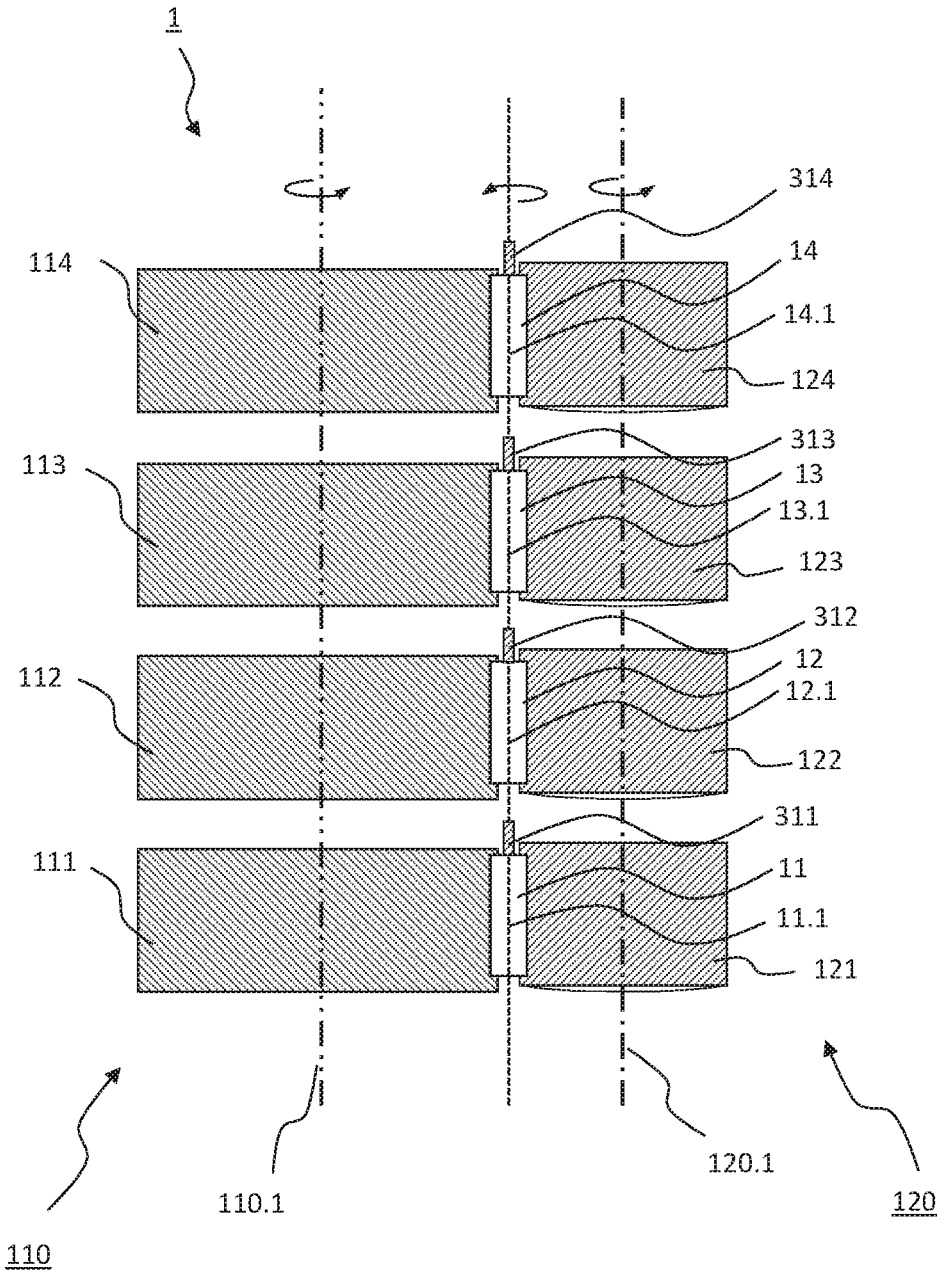
FIG. 2 shows a horizontal cross section through the grinding device according to FIG. 1.
Figure 3:
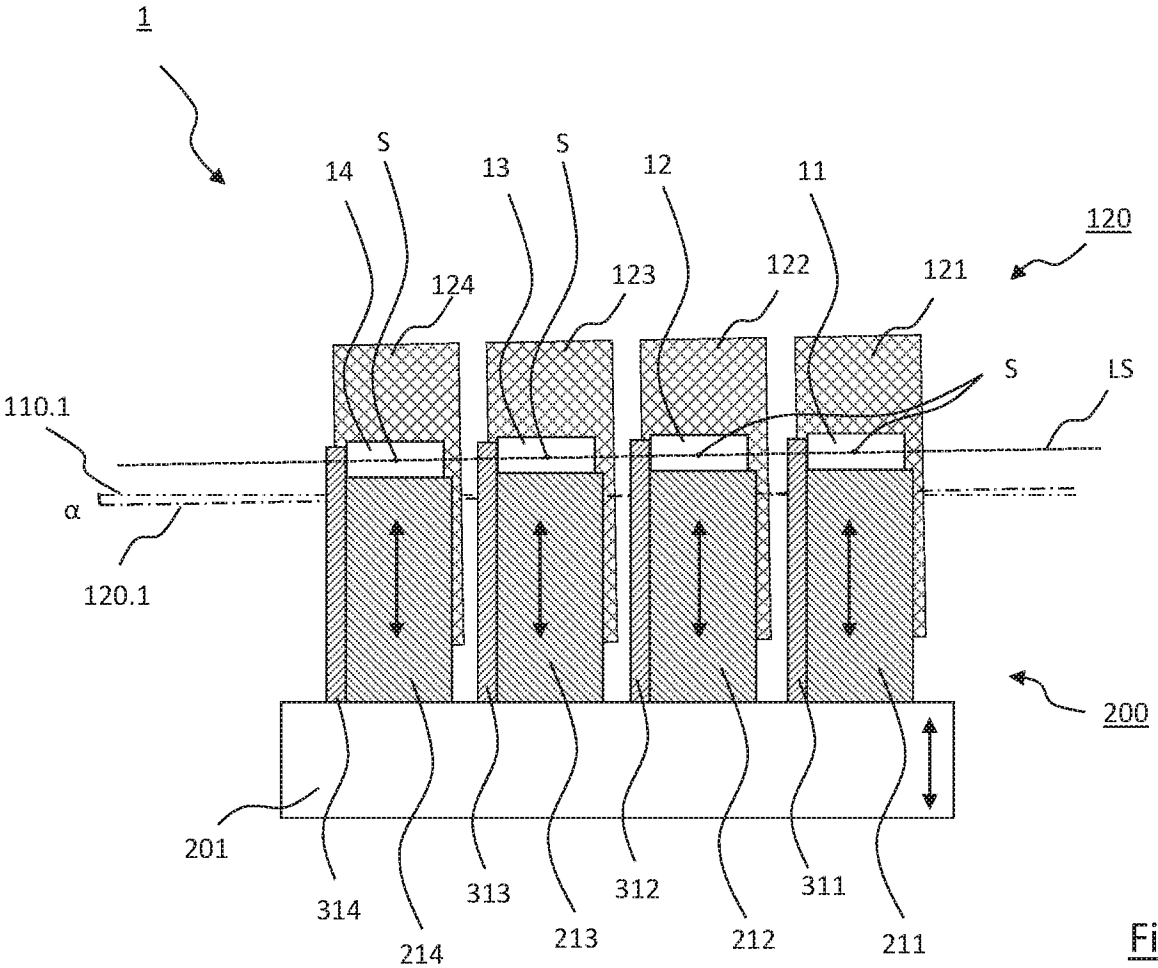
FIG. 3 shows a vertical cross section through the grinding device according to FIG. 1.

FIGS. 1 to 3 show one possible embodiment of a grinding device 1 according to the invention for simultaneous centreless cylindrical grinding of multiple workpieces 11, 12, 13, 14. In the present case, workpieces 11, 12, 13, 14 are identical, rotationally substantially symmetrical cylindrical bodies which are to be ground to receive a diameter of uniform dimension and roundness in the round grinding method of the invention with the aid of the grinding device 1 according to the invention.

FIGS. 1 to 3 are diagrammatic representations of the centreless cylindrical grinding process. Workpieces 11, 12, 13, 14 are arranged one behind the other in the direction of the workpiece axes of rotation 11.1, 12.1, 13.1, 14.1 and are supported on a fence-like support apparatus 200 in the "grinding gap" between grinding wheel 110 and regulating wheel 120. In the present embodiment, both the regulating wheel 120 and the grinding wheel 110 comprise one partial regulating wheel 121, 122, 123, 124 and one partial grinding wheel 111, 112, 113, 114 for each workpiece 11, 12, 13, 14. Each partial regulating wheel 121, 122, 133, 124 and each partial grinding wheel 111, 112, 113, 114 is arranged on a common axis of rotation of the regulating wheel 120.1 or a common axis of rotation of the grinding wheel 110.1 respectively, by means of which the partial grinding wheels and partial regulating wheels may be caused to rotate. In the embodiment shown of the grinding device 1 according to the invention, all workpieces 11, 12, 13, 14 are positioned above the connecting line between the grinding wheel axis of rotation 110.1 and the regulating wheel axis of rotation 120.1, i.e. grinding is performed "above centre". Tangents T on the partial regulating wheels 121, 122, 123, 124 in the contact point of workpieces 11, 12, 13, 14 form "bearing angle" $\gamma$ relative to the vertical or plumb L of the workpieces 11, 12, 13, 14 on the respective partial regulating wheels 121, 122, 133, 124, which angle is critical for determining the achievable roundness of workpieces 11, 12, 13, 14.

During the grinding process, workpieces 11, 12, 13, 14 are driven by the slowly rotating partial regulating wheels 121, 122, 133, 124 and machined by the relatively faster rotating partial grinding wheels 111, 112, 113, 114. The support apparatus and partial grinding wheels 111, 112, 113, 114 support the workpiece over at least a part of its length and absorb the forces that are generated by machining. The grinding device 1 presented here is used for "inline plunge grinding". For this, the grinding wheel axis of rotation 110.1 and the regulating wheel axis of rotation 120.1 are aligned side by side and substantially parallel. However, the axis of rotation of regulating wheel 120.1 is inclined with respect to a horizontal plane extending parallel to the grinding wheel axis of rotation 110.1 and to the workpiece axes of rotation 11.1, 12.1, 13.1, 14.1 by an inclination angle $\alpha$. For plunge grinding, inclination angle $\alpha$ typically has a value of about 0.5°. In this way a thrust in the direction of the workpiece axes of rotation 11.1, 12.1, 13.1, 14.1 is exerted on workpieces 11, 12, 13, 14 by the rotation of partial regulating wheels 121, 122, 123, 124, which thrust is used to press workpieces 11, 12, 13, 14 against a respective (axial) limit stop 311, 312, 313, 314 to hold the workpieces fixedly in the axial direction in grinding device 1.

If workpieces 11, 12, 13, 14 were arranged at the same height with respect to the horizontal—as is standard in the prior art—the inclination of the regulating wheel axis of rotation 120.1 would cause the workpieces to bear on the partial regulating wheels 121, 122, 123, 124 at different bearing angles $\gamma$ in each case. However, in the context of the invention it was found that this results in inconsistent grinding results, particularly inconsistent roundnesses and diameters in workpieces 11, 12, 13, 14 that are ground simultaneously in one grinding cycle. To counteract this. It is provided according to the present invention to arrange the workpieces 11, 12, 13, 14 in the grinding gap with a height offset relative to each other corresponding to the inclination angle $\alpha$ of the regulating wheel axis of rotation 120.1, and preferably—as in the present—in such manner that each workpiece has substantially the same bearing angle $\gamma$ on the inclined regulating wheel 12, particularly, that the bearing angles $\gamma$ of all workpieces 11, 12, 13, 14 on the respective partial regulating wheels 121, 122, 133, 124 are the same, i.e. identical. For this, the workpieces 11, 12, 13, 14—as shown in FIG. 3—are disposed one behind the other and with a height offset on support apparatus 200 in such manner that a notional connecting line LS through the geometrical centres of gravity S of workpieces 11, 12, 13, 14 extends parallel to the inclined regulating wheel axis of rotation 120.1.

The embodiment of grinding device 1 represented here shows a possible and particularly advantageous variant of support apparatus 200 for the purpose of achieving the inventive height-offset arrangement of workpieces 11, 12, 13, 14, corresponding to inclination angle $\alpha$ of regulating wheel axis of rotation 120.1. For each of the workpieces 11, 12, 13, 14 the support apparatus has one support 211, 212, 213, 214, each with a support surface which rises transversely to the grinding gap towards grinding wheel 110, on which the corresponding workpieces 11, 12, 13, 14 are supported during grinding. The various supports 211, 212, 213, 214 are offset from each other in the manner of steps corresponding to inclination angle $\alpha$ of the regulating wheel axis of rotation 120.1 axially, i.e. along the grinding gap. In particular, the supports 211, 212, 213, 214 in the present embodiment are designed as support elements 201, 202, 203, 204 which are separately height-adjustable (indicated by the double-headed arrows in FIG. 3). In this way, it is advantageously possible to make fine adjustments to the height offset of the individual workpieces 11, 12, 13, 14 and/or adapt support apparatus 200 for simultaneous grinding of workpieces with differing geometries. All support elements 201, 202, 203, 204 are arranged on a common support base 230, which itself is designed to be height-adjustable as a unit, so that the height of the entire support apparatus 200 is adjustable as a unit. Set screws or actuators for example may be provided for adjusting the height of support elements 201, 202, 203, 204 and support base 230.

In order to be able to dress regulating wheel 120 or partial regulating wheels 121, 122, 123, 124 along the regulating wheel axis of rotation 120.1 at different heights corresponding to the height-offset arrangement of the workpieces, it may be provided that grinding device 1 is equipped with a height-adjustable dressing device (not shown here). Of course, in addition to the height adjustment capability the dressing device may also be constructed such that it can be displaced and advanced axially along the grinding gap and/or horizontally. It may also be provided for the grinding wheel 110 or the partial grinding wheels 111, 112, 113, 114 to be dressed before the grinding operation, preferably with the aid of the height-adjustable dressing device, and also at the places where the workpieces bear on the grinding wheel during grinding corresponding to their height-offset arrangement. In particular it may be provided that grinding wheel 110 or the partial grinding wheels 111, 112, 113, 114 are dressed to different diameters along the grinding wheel axis of rotation 110.1, to ensure that the grinding wheel 110 or partial grinding wheel 111, 112, 113, 114 are each brought into optimal grinding contact with workpieces 11, 12, 13, 14 taking into account the height-offset arrangement thereof.

The invention claimed is:

1. A method for simultaneous centreless cylindrical grinding of multiple workpieces at least sections of which are rotationally symmetrical, wherein the workpieces for grinding are arranged one behind the other in the direction of the workpiece axes of rotation on a support apparatus between at least one grinding wheel and at least one regulating wheel, and wherein the axis of rotation of the regulating wheel is inclined by an inclination angle (α) with respect to a particularly horizontal plane extending parallel to the workpiece axes of rotation and the grinding wheel axis of rotation, wherein during grinding the workpieces are disposed with a height offset with respect to each other corresponding to at least a quarter, particularly at least half, preferably at least three quarters of the inclination angle (α) of the regulating wheel axis of rotation relative to the parallel plane so that the respective bearing angles (γ) of the workpieces on the inclined regulating wheel are rendered consistent.

2. The method according to claim 1, wherein during grinding the workpieces are disposed one behind the other on the support apparatus with a height offset corresponding to the inclination angle (α) of the regulating wheel in such manner that a notional connecting line (LS) through the geometrical centres of gravity (S) of the workpieces extends parallel to the inclined regulating wheel axis of rotation; and/or during grinding the workpieces are disposed one behind the other on the support apparatus with a height offset corresponding to the inclination angle (α) of the regulating wheel axis of rotation in such manner that each of the workpieces have substantially the same bearing angle (γ) on the inclined regulating wheel.

3. The method according to claim 1, wherein the regulating wheel is dressed before grinding by means of a height-adjustable dressing device at the places where the workpieces bear on the regulating wheel during grinding according to their height-adjusted arrangement.

4. A device for simultaneous centreless cylindrical grinding of multiple workpieces at least sections of which are rotationally symmetrical, for carrying out the method according to claim 1, with at least one grinding wheel and at least one regulating wheel, between which the workpieces can be disposed for grinding on a support apparatus one behind the other in the direction of the axes of rotation and wherein die axis of rotation of the regulating wheel is tiltable about an inclination angle (α) with respect to a particularly horizontal plane which extends parallel to the workpiece axes of rotation, and the grinding wheel axis of rotation, wherein the support apparatus is constructed in such manner that during grinding the workpieces are arranged with a height offset with respect to each other that corresponds to at least a quarter, particularly at least half, preferably at least three quarters of the inclination angles (α) of the regulating wheel axis of rotation relative to the parallel plane, so that the respective bearing angles (γ) of the workpieces on the inclined regulating wheel can be made consistent.

5. The device according to claim 4, wherein the support apparatus is constructed in such manner that during grinding a notional connecting line (LS) through the geometrical centres of gravity (S) of the workpieces is aligned parallel to the inclined axis of rotation of the regulating wheel; and/or the support apparatus is constructed in such manner that during grinding the workpieces are arranged with a height offset with respect to each other corresponding to the inclination angle (α) of the axis of rotation of the regulating wheel in such manner that each workpiece bears on the inclined regulating wheel at substantially the same bearing angle (γ).

6. The device according to claim 4, wherein the support apparatus is constructed so as to be height-adjustable as a whole and/or that the support apparatus is constructed so as to be replaceable as a whole.

7. The device according to claim 4, wherein the support apparatus is equipped with multiple supports arranged one behind the other in the direction of the axes of rotation thereof to support the multiple workpieces, which supports are arranged with height offset relative to each other corresponding to the inclination angle (α) of the regulating wheel axis of rotation, in particular that the support apparatus is designed in step-like manner to support the multiple workpieces and/or that the supports are arranged one behind the other in a stepped configuration.

8. The device according to claim 7, wherein at least one, preferably each of the multiple supports is constructed so as to be separately height-adjustable, in particular that at least one, preferably each of the multiple supports is constructed as a separately height-adjustable support element.

9. The device according to claim 7, wherein at least one, preferably each of the multiple supports is separately tiltable out of the horizontal with respect to the grinding wheel axis of rotation, in particular that at least one, preferably each of the multiple supports is constructed as a support element that is separately tiltable out of the horizontal with respect to the grinding wheel axis of rotation.

10. The device according to claim 7, wherein at least two of the supports are fixedly arranged with a height-offset with respect to each other corresponding to the inclination angle (α) of the regulating wheel axis of rotation, in particular that they are not separately height-adjustable.

11. The device according to claim 4, wherein the grinding wheel comprises multiple partial grinding wheels arranged one behind the other on the grinding wheel axis of rotation, and the regulating wheel comprises multiple partial regulating wheels arranged one behind the other on the regulating wheel axis of rotation, wherein preferably one partial grinding wheel and one partial regulating wheel are provided for each workpiece to be ground.

12. The device according to claim 4, wherein the device has at least one limit stop for each workpiece, on which the workpiece bears in the direction of the axis of rotation of the workpiece during grinding.

13. The device according to claim 4, wherein the device is equipped with at least one movable, particularly height-adjustable dressing device for dressing the at least one regulating wheel and/or the at least one grinding wheel, in particular in order to dress the regulating wheel before grinding at the places where the workpieces bear on the regulating wheel according to their height-offset arrangement.

14. The device according to claim 4, wherein the grinding wheel axis of rotation extends substantially parallel to the workpiece axes of rotation for inline plunge grinding or that the grinding wheel axis of rotation is aligned at an angle to the workpiece axes of rotation for offset plunge grinding.

* * * * *